US006077208A

United States Patent [19]

Larkin et al.

[11] Patent Number: 6,077,208

[45] **Date of Patent: *Jun. 20, 2000**

[54] STABLE FLEXIBLE POUCH AND METHOD FOR MAKING THE POUCH

[75] Inventors: Robert G. Larkin, Richmond, Tex.; Mark W. Holmes, Round Lake Beach, Ill.

[73] Assignee: The Coca-Cola Company, Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 09/122,866

[22] Filed: Jul. 27, 1998

Related U.S. Application Data

[62] Division of application No. 08/757,822, Nov. 27, 1996.

[51] Int. Cl.[7] ..... B31B 1/14

[52] U.S. Cl. ..... 493/223; 493/237

[58] Field of Search ..... 493/209, 218, 493/219, 223, 229, 232, 237

[56] References Cited

U.S. PATENT DOCUMENTS

| | | | |
|---|---|---|---|
| D. 362,618 | 9/1995 | Paling et al. . | |
| 2,232,088 | 2/1941 | Waters . | |
| 3,003,681 | 10/1961 | Orsini . | |
| 3,337,117 | 8/1967 | Lehmacher et al. . | |
| 3,405,859 | 10/1968 | Phillips, Jr. . | |
| 3,474,789 | 10/1969 | Soto . | |
| 3,765,309 | 10/1973 | Joice | 493/237 |
| 4,094,457 | 6/1978 | Spillson . | |
| 4,363,345 | 12/1982 | Scheibner . | |
| 4,818,544 | 4/1989 | Seward . | |
| 5,080,260 | 1/1992 | During . | |
| 5,375,930 | 12/1994 | Tani . | |
| 5,411,203 | 5/1995 | Bochet et al. . | |
| 5,830,118 | 11/1998 | Nicholson | 493/209 |

FOREIGN PATENT DOCUMENTS

| | | |
|---|---|---|
| 215885 | 6/1961 | Austria . |
| 0768248 | 4/1997 | European Pat. Off. . |
| 1128387 | 1/1957 | France . |
| 639809 | 5/1962 | Italy . |
| 1109861 | 4/1968 | United Kingdom . |

*Primary Examiner*—John Sipos
*Assistant Examiner*—Steven Jensen
*Attorney, Agent, or Firm*—Finnegan, Henderson, Farabow, Garrett & Dunner, L.L.P.

[57] ABSTRACT

A flexible pouch includes a flexible compartment with a bottom. A rim is formed around the bottom of the compartment and is spaced from and extends outwardly from this compartment bottom. At least three coplanar feet are provided on the rim for stabilizing the pouch when the pouch is resting on the rim. These coplanar feet can be generally flush with the rim when the pouch is in a flat, empty position. However, when the compartment of the pouch is filled, the coplanar feet will be formed as the lowermost portions of the rim. The pouch will rest on these coplanar feet when on a support to be stably held in position. This pouch design will avoid wobbling or tipping over of the pouch and therefore minimize or eliminate product spillage. Also, a method for making this pouch includes the steps of forming the pouch with the compartment, providing a rim around the bottom of the compartment, and spacing the rim from the bottom of the compartment. A portion of this rim is then removed at the outer edge to form the plurality of coplanar feet.

6 Claims, 2 Drawing Sheets

STABLE FLEXIBLE POUCH AND METHOD FOR MAKING THE POUCH

This application is a divisional of copending application Ser. No. 08/757,822, filed on Nov. 27, 1996, the entire contents of which are hereby incorporated by reference.

BACKGROUND OF THE INVENTION

1. Field of the Invention

The present invention relates to a stable flexible pouch with a flexible compartment and a method for making the pouch. This pouch has a rim encircling the bottom of the compartment with portions of the rim being removed in order to form stabilizing coplanar feet.

2. Description of the Background Art

Various flexible pouches are known in the prior art. These flexible pouches are often unstable when resting on a support. For example, flexible pouches can be made from two sheets sealed together, an extruded tube or other methods. When these pouches are filled, they are often unstable when resting on a support surface. This leads to unnecessary spills resulting in wasted product and a mess.

For example, known flexible pouches are used for as beverage containers. When resting on a table, for example, these pouches have a tendency to wobble and therefore be unstable. These prior art pouches can then easily tip over and the juice or other beverage spilled therefrom. This is especially a problem when children handle the pouches. Accordingly, a need in the art exists for a flexible pouch which can stably rest on a support.

SUMMARY OF THE INVENTION

Accordingly, it is a primary object of the present invention to provide a flexible pouch which can stably rest on a support surface.

Another object of the present invention is to provide a flexible pouch with a flexible compartment for holding contents such as a beverage and which pouch will not rock, tilt or otherwise wobble when filled and resting on a support surface.

Yet another object of the present invention is to provide a flexible pouch which is relatively easy and inexpensive to produce and easy to handle.

Still another object of the present invention is to provide a method for making the stable flexible pouch.

These and other objects of the present invention are fulfilled by providing a flexible pouch comprising a flexible compartment having a bottom; a rim formed around the bottom of the compartment, the rim being spaced from and extending outwardly from the bottom of the compartment; and at least three coplanar feet provided on the rim for stabilizing the pouch when the pouch is resting on the rim.

In addition these and other objects of the present invention are fulfilled by providing a method for making a stabilized flexible pouch comprising the steps of forming a pouch with a compartment, the compartment having a bottom; providing a rim around the bottom of the compartment; spacing the rim from the bottom of the compartment, the rim having an outer edge spaced from the compartment; and removing a portion of the rim at the outer edge to form a plurality of coplanar feet on the rim.

Additionally, these and other objects of the present invention are fulfilled by a flexible pouch comprising a flexible compartment having a bottom, the pouch being flat when the compartment is empty and the pouch being expanded when the compartment is filled; a rim encircling the bottom of the compartment, the rim extending outwardly from the bottom of the compartment, the rim including a first rim section and a second rim section, ends of the first and second rim sections being in engagement, each rim section including a middle portion and two beveled end portions, the rim sections having an outer edge spaced from the compartment; and at least three coplanar feet provided on the rim for stabilizing the pouch when the pouch is resting on the rim on a support surface, the at least three coplanar feet engaging the support surface when the pouch is resting on the rim, each of the middle portions of each of the rim sections having at least one of the coplanar feet thereon, the coplanar feet extending outwardly beyond the beveled end portions such that the beveled end portions are out of contact with the support surface on which the pouch rests.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
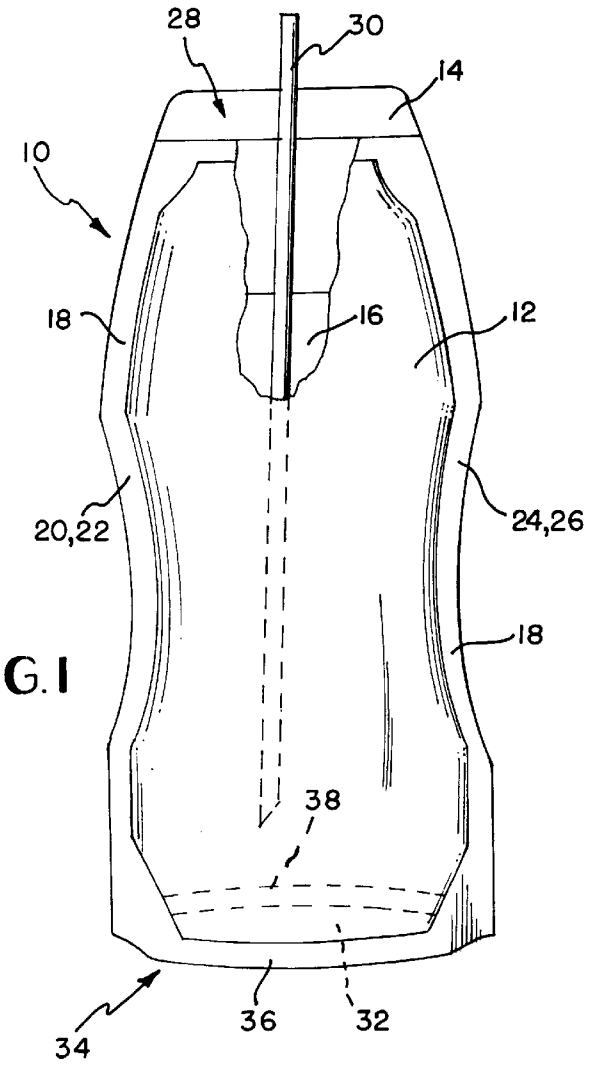
FIG. 1 is a front elevational view of the flexible pouch of the present invention with certain portions broken away.

Referring in detail to the drawings and with particular reference to FIG. 1, a flexible pouch 10 is shown. This flexible pouch can be made from a heat-sealable, heat-weldable or ultrasonic sealing flexible laminate such as an aluminum sheet covered with a plastic material or from any other suitable material. The pouch 10 can be filled with liquid such as beverages, liquid, pasty media, fine granular material or any other suitable objects. It is contemplated that the flexible pouch will primarily be used as a beverage container.

As seen in FIG. 1, this flexible pouch 10 generally has an hour glass or figure eight shape. The flexible pouch is made from a first sheet 12 and a second sheet 14. In FIG. 1, the first sheet 12 is in front of the second sheet 14. The shape of the first sheet 12 matches the second sheet 14 except at the uppermost edge thereof. In particular, the second sheet 14 is slightly longer than the first sheet 12 such that the upper edge of the second sheet 14 extends above the upper edge of the first sheet 12. The two sheets 12 and 14 are sealed together around their periphery to form a compartment 16. The compartment 16 formed between the first and second sheets 12, 14 will hold the contents of the flexible pouch 10. For example, a beverage can be placed within this compartment 16. It is contemplated that this compartment will initially be hermetically sealed.

A seam 18 extends along the sides of the first and second sheets 12 and 14. While the seam is shown as being continuous in the figures, it should be appreciated that it could be discontinuous as long as the compartment 12 is sealable. This seam 18 can be formed by heat-sealing, heat-welding or ultrasonic sealing the two sheets 12 and 14 together. Otherwise, adhesives, crimping or any other suitable arrangement can be used in order to bond these sheets together. Also, a single extruded tube can be used in place of the two sheets 12, 14. Alternatively, a single sheet can be folded over on itself and can have its free ends bonded together to thereby define a portion of the sealed compartment 12. It is merely necessary that an appropriate sealed compartment 12 be provided. It is contemplated that this compartment 12 will be fluid tightly sealed as noted above.

A first edge 20 of the first sheet 12 and a first edge 22 of the second sheet 14 are provided on the left-hand side of the pouch 10 as seen in FIG. 1. The seam 18 extends along these first edges 20, 22. In addition, a second edge 24 on the first sheet 12 and a second edge 26 on the second sheet 14 are provided along the right-hand side of the flexible pouch 10. The edges 22, 26 of the second sheet 14 are behind the first edges 20, 24 respectively, of the first sheet 12. The edges 20, 22 and the edges 24, 26 conform such that the shape of the first and second sheets 12, 14 along the sides of the pouch 10 are uniform. Of course, one sheet could be slightly larger than the other sheet on either or both sides of the compartment. As previously noted, the first edges 20, 22 are sealed together and the second edges 24, 26 are sealed together.

In the pouch shown in FIG. 1, a pocket 28 is provided at the top of the pouch 10 for receiving straw 30. This straw 30 can pierce the material of the pocket in order to be inserted into the compartment 16. The contents of the pouch 10 can then be discharged. In other words, a consumer can drink the beverage contained within the pouch 10 through straw 30.

Encircling the bottom 32 of the compartment 16 is rim 34. This rim comprises a first rim section 36 and a second rim section 38. This first rim section 36 is actually the outwardly extending seam between the first sheet 12 and the material of the bottom 32 of the compartment. The second rim section 38 is the outwardly extending seam between the second sheet 14 and the material of the bottom 32 of compartment 16. These rim sections 36, 38 together form the complete rim 34. Ends of the rim sections 36, 38 are engaged and bonded together. When forming the pouch such as by heat-sealing, heat-welding or ultrasonic bonding, the seams 18 and seam of the rim 34 are formed. The seams extend completely along the height of the rim 34. In other words, the bottom 32 of the compartment 16 has a corner adjacent the termination of this lower seam and therefore adjacent the rim 34. The rim 34 extends completely around the bottom 32 of the compartment thereby encircling this bottom 32. The height of the rim will vary as will be discussed below. The seam forming the rim extends into the two side seams 18.

As seen in FIG. 1, the left-hand seam 18 is partially bent forwardly while the right-hand seam 18 is bent rearwardly (or into the page). While this particular design is shown in FIG. 1, it should be appreciated that the seams 18 could extend in a reverse direction or both seams could extend either forwardly or rearwardly or could be straight out. In this FIG. 1, the compartment 16 of the pouch 10 is filled. Therefore, pouch 10 will bulge outwardly. When the compartment is empty, it is contemplated that the pouch will be flat as seen in FIG. 2.

Figure 2:
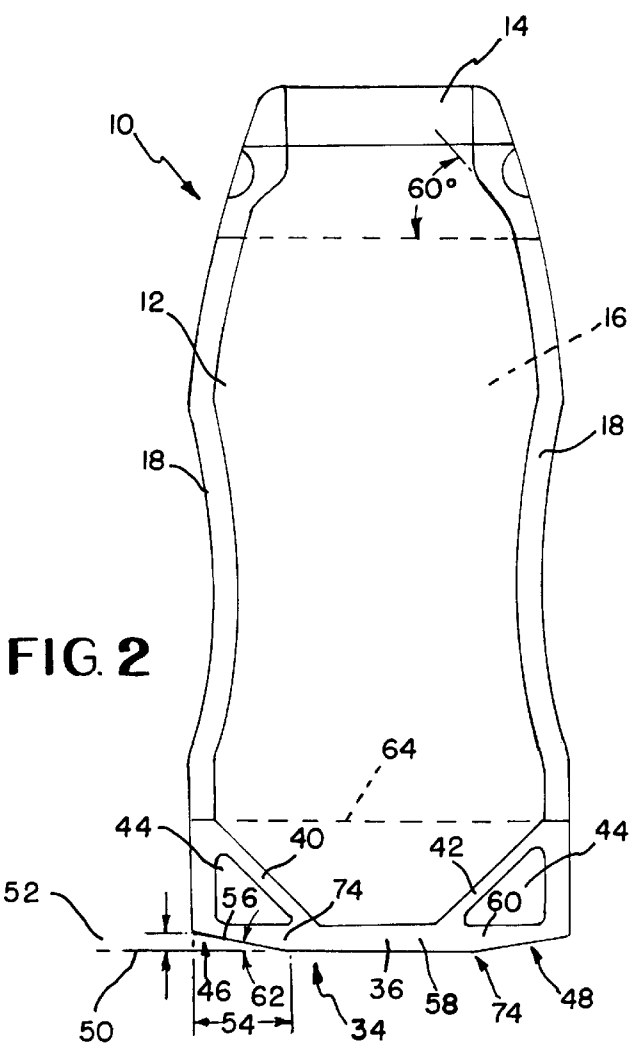
FIG. 2 is a view similar to FIG. 1 of an empty pouch.

In particular, FIG. 2 shows the flat pouch 10 in elevational view with certain seam features emphasized. In FIG. 2, the second rim section 38 is behind the first rim section 36. These two rim sections are abutting one another when the container is flat. As can be seen in FIG. 2, the seam along this first rim section 36 runs into each of the side seams 18. In addition, a cross seam 40 is formed at the lower left-hand portion of the compartment 16 while another cross seam 42 is formed at the right-hand lower side of compartment 16. The bottom 32 of the compartment is engaged with the sheets 12 and 14 along these cross seams 40, 42 and is out of engagement with the rim 34 which extends onto the side seams 18.

These seams 40, 42 are not readily visible when viewing the exterior of the container. A thin line or patterned section may merely be visible on the exterior of the pouch indicating where the seams are heat-sealed, heat-welded, ultrasonically sealed or otherwise formed or no visible indication may be provided on the exterior of pouch 10. Formation of these seams provides heat sinks 44. These heat sinks 44 are merely areas which are omitted or cut out from the seal dies when forming pouch 10. Any suitably sized or shaped or number of heat sinks 44 can be used or they can be omitted altogether.

As seen in FIG. 2, the outer edges of the first rim section 36 are beveled as indicated at 46 and 48. Similar to the first rim section 36, second rim section 38 also has matching beveled ends 46, 48. In FIG. 2, a support surface 50 on which the pouch 10 rests is shown. The support surface can be a table, or any other suitable surface. The pouch 10 is placed on the support 50 in an upright position as indicated in FIG. 10. In other words, the longitudinal axis of the pouch 10 will be vertically positioned and will be generally perpendicular to the top of support surface 12.

As seen on the left-hand side of FIG. 2, the beveled outer ends 46, 48 of the first rim section 36 will be spaced from the support 50 by a distance 52. This distance can be an eighth of an inch (0.13 inch), for example. The right-hand beveled outer edge 48 is also similarly spaced from the support 50. This support 50, however, has not been shown on the right-hand side in order to more clearly show the beveled end 48. The distance 54 or length of the beveled end 46 can be ¾ inch (0.75 inches), for example. It is contemplated that the right-hand beveled outer end 48 will also have similar dimensions to the left-hand outer end 46. In other words, the bottom of the pouch 10 will be symmetrical.

Of course, this bottom can be asymmetrical, if so desired. For example, the length 54 of the bevel or the depth 52 of the bevel could be different from side to side of the pouch, if so desired. Also, any suitable length 54 or depth 52 can be used. These particular dimensions will depend upon the bottom design of the pouch 10. For example, a wider pouch with a larger compartment 16 would have a different sized cut for the bevel of end 46, 48 than a smaller or narrower sized pouch.

Due to the provision of these outer beveled ends 46, 48, the first rim section 36 is actually divided into a first beveled end portion 56, a middle portion 58, and a second beveled end portion 60. The middle portion 58 is between the first and second beveled end portion 56, 60. While FIG. 2 shows the first rim section 36 as having these portions 56, 58, and 60, it should be appreciated that the second rim section 38 also has such portions 56, 58, and 60. It is contemplated that the portions sections 36, 38 will be sized the same such that the rim 34 is symmetrical from front to back. Of course, the length or depth of the bevel can vary between the first rim section 36 and second rim section 38, if so desired. Nonetheless, for greater stability, these bevels should match between the first rim section 36 and second rim section 38.

When forming the pouch 10, a blank can be made for the pouch. This blank will have the bottom corners cut away in order to form the beveled end portions 56, 60. It is possible that this step of cutting away the corners of the pouch can be done before the first and second sheets 12, 14 are bonded together or after this step is carried out. Of course if the pouch 10 is formed from an extruded tube, for example, there would be no step of bonding sheets together.

Due to the provision of the beveled end portions 56, 60, an angle 62 will be formed between the beveled end portions and the support 52 as indicated in FIG. 2. When the first and second beveled end portions 56, 60 are symmetrical, this angle 62 will be the same on both the left and right sides of the pouch 10. If a ¾ inch by ⅛ inch wedge cut is made at the bottom of the pouch, the angle 62 can be found from the following formula:

$$\theta = \text{ARCTAN}\frac{.13}{.75} = 9.83^{\circ}.$$

While an example of an angle of 9.83° has been given, it should be noted that this angle can be between 4 and 25°. More specifically, the angle can generally be between 8 and 15°. If too much of the bottom rim 34 is cut away, then the lower seal for compartment 16 could be affected or the area of heat sink 44 could be interfered with. However, if too little material is cut away, it can be difficult to remove the cut-away portion or scrap from the die. Therefore, a certain size angle is necessary. However, this angle can vary depending upon the size of the cut for the beveled outer ends 46, 48 which is dependent upon the size of the pouch 10.

While the cut for the outer ends 46, 48 has been shown and described as a straight cut, it should be appreciated that an inwardly or outwardly curved cut could be used. Also, a sawtooth cut, a wavy cut or any other type of cut is possible. It is merely necessary that the outermost-edges of the seams 18 are out of contact with the support surface 50 when the pouch is resting thereon.

In FIG. 2, the pouch 10 is shown in a flat position. The bottom 64 is folded in half along crease line 64 schematically indicated in FIG. 2. The sheet or membrane which makes the bottom 32 of compartment 16 is affixed to a part of the middle portion 58 of the first and second sections 36, 38 of the rim. Then the membrane of the bottom 32 of the compartment 16 is sealed along the inclined cross seams 40, 42 on both the first and second sheets 12 and 14. When the compartment 16 is filled, downward pressure will be exerted on the bottom 32 of the compartment. The folded area indicated at 64 will move downwardly in order to form a bowl shape for the bottom membrane. Put another way, when viewing this bottom membrane from the exterior of the pouch 10, the membrane will have a convex U-shape. In FIG. 1, the membrane of the bottom 32 has merely been shown as generally being flat in order to simplify illustration of the pouch.

Figure 5:
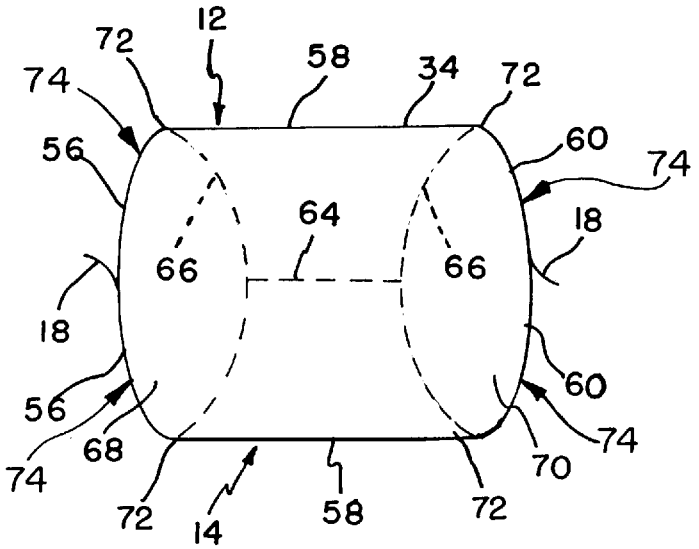
FIG. 5 is a bottom view of the pouch of the present invention.

However, FIG. 5 shows the bottom of pouch 10. Lines 66 indicate how the edge of the flat bottom portion (which is the lowermost portion) of the membrane of the bottom 32 is positioned relative to rim 34. While the crease formed by fold 64 is partially shown in FIG. 5, it should be appreciated that this crease may actually disappear or at least be generally flush with the bottom 32 of the compartment 16 when the pouch 10 is filled.

Because the membrane of the bottom 32 of compartment 16 is sealed along the cross seams 40 of both the first and second sheets 12, 14, there is a slight space or recess 68, 70 formed at the sides of bottom 32 of the pouch 10. It should be appreciated that because the material of the membrane of the bottom 32 of compartment 16 is a flexible material, the exact shape of the bottom membrane can vary. For example, if the pouch was squeezed on one side, the lines 66 indicating the periphery of the flat section of the bottom could shift. FIG. 5 should nonetheless indicate that a majority of the bottom membrane is generally flat and exposed when pouch 10 is filled. This membrane of the bottom 32 of compartment 16 is spaced from the support as schematically indicated in FIG. 1. In other words, the rim 34 positions the bottom 32 of the compartment 16 away from support surface 50 when the compartment 16 is filled.

As seen in FIG. 5, both the first sheet 12 and second sheet 14 have the rims 34 divided into the first beveled end portion 56, middle portion 58, and second beveled end portion 60. This arrangement has been discussed above. The first and second beveled end portions 56, 60 generally terminate before the area of the corners 72. While areas 72 have been referred to as corners, it should be appreciated that these corners will actually be movable due to the flexible nature of the pouch and membrane of the bottom 32 of compartment 16. For example, if the one side of the pouch in FIG. 5 were compressed, then the corners 72 could move to a different position. Nonetheless, in the normal filled position, the corners 72 will be spaced from the innermost ends 74 of the beveled end portions 56, 60. Moreover, it should be appreciated that these corners 72 are not actually square corners but rounded areas forming a transition between the sides and front of the pouch and between the sides and back of the pouch 10.

It is contemplated that the first sheet 12 and second sheet 14 as well as the membrane of the bottom 32 of compartment 16 will be made from the same material. For example, a flexible laminate such as an aluminum sheet cover with a plastic material can be used or any other suitable material can be used. Also, the membrane of the bottom 32 of compartment 16 could be made from different materials than the sheets 12, 14.

Figure 3:
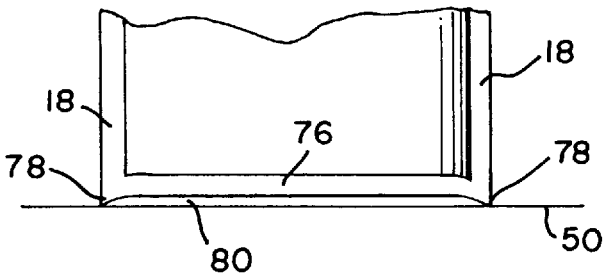
BACKGROUND ART FIG. 3
FIG. 3 is a schematic sectional view showing a lower front portion of a pouch indicating the state of the background art.

To better understand the present invention, a portion of a filled conventional stand-up pouch is shown in FIG. 3. In this arrangement, the beveled end portions 56 and 60 have not been cut away from the outer edge of the rim. This pouch of FIG. 3 is not to be equated with the pouch shown in FIGS. 1 and 2 of the present application. In particular, the pouch may not have the figure eight or hour glass shape or the pocket 28, for example. However, this conventional pouch will generally have side seams 18 similarly to the pouch of the present invention.

A rim 76 is also provided at the bottom of the pouch of FIG. 3. The compartment of this pouch is filled since this pouch is in an expanded position. In such a position, the lowermost points of the pouch will be formed at the outermost edge of the seams 18. These lowermost portions form contact points 78 with the support surface 50. The distance 80 between the outer edge of rim 76 and support surface 50 is exaggerated in FIG. 3. This distance may actually be only a few millimeters. Nonetheless, the pouch is generally supported at the two contact points 78 when resting on support 50 with the remainder of the rim being raised out of contact with support surface 50. Because there are only two main contact points 78, the pouch will wobble or teeter back and forth. In other words, the pouch will move into and out of the page as shown in FIG. 3 while pivoting about the contact points 78.

When the pouch of FIG. 3 tips sufficiently forwardly, a forward portion of the rim 76 will engage the support 50 such that three contact points will be formed. The three points will be at this contact at the forward rim and at the two contact points 78. In this position, the pouch will rest, but it will be unstable. With only a slight rearward force, the pouch will move rearwardly, pivoting about points 78. A point on the rear rim will then contact the support surface 50. The pouch of the prior art is unstably held and teeters or wobbles when resting on support 50. This unstable arrangement is undesirable and leads to the pouch easily tipping over. The contents will then spill from the pouch, wasting the product and leading to a mess.

Because the potential contact points on either the forward portion of the rim or the rearward portion of the rim are not coplanar with the contact points 78, this pouch will wobble as noted above. When the forward and rear portions of the rim 76 are discussed, it should be appreciated that the pouch shown in FIG. 3 can be made from two separate sheets or a tubular sheet. In either arrangement, a forwardmost rim 76 as seen in FIG. 3 will be provided. The rear rim is hidden from view but is positioned behind and spaced from the forward rim 76. These two rim sections basically encircle the bottom of the compartment similarly to the rim sections 36, 38 of the present invention.

Figure 4:
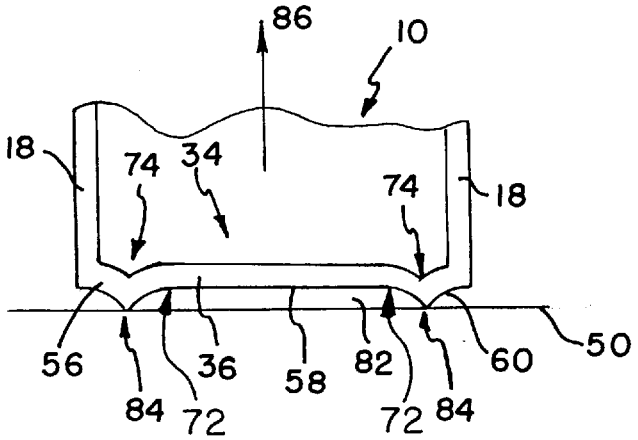
FIG. 4 is a view similar to FIG. 3 showing a portion of a lower side of the pouch of the present invention.

Turning now to FIG. 4, a schematic illustration of a filled pouch 10 of the present invention is shown. This figure shows the first sheet 12 or second sheet 14 at the front pouch. In either arrangement, the rim 34 is provided with the previously noted first beveled end portion 56, middle portion 58, and second beveled end portion 60. Also, as previously been noted, four corners 72 are generally formed around the pouch. Two such corners 72 are shown in FIG. 4 whereas the two corresponding corners would be located behind the two shown in the figures.

When the pouch 10 is in the flat position as shown in FIG. 2, the middle portion 58 of rim 34 is generally straight and flat as seen in FIG. 2. However, when the compartment 16 is filled, the pouch will bulge and form corners 72. These corners 72 can move about the periphery of the rim due to the flexible nature of the pouch. Nonetheless, four corners are generally formed as indicated and discussed with regard to FIG. 5. Two of the innermost ends 74 of the beveled end portions 56, 60 are shown in FIG. 4 and they form two of coplanar feet 84 of the present invention. At each innermost end a coplanar foot 84 would be formed. Each of these feet 84 are in the same plane. These feet are the lowermost portion of the outer edge of rim 34. They will engage the surface 50 and provide for a stable support.

In other words, four coplanar feet 84 are provided around the periphery of the pouch 10. These feet 84 are in the same plane and will result in the filled pouch 10 being stably held in position. The middle portion 58 of rim 34 is otherwise slightly spaced from the support 50 as indicated by distance 82 in FIG. 4. This distance is exaggerated similarly to the distance 80 in FIG. 3 and can in fact only be a few millimeters. Nonetheless, the pouch 10 of the present invention generally has four coplanar feet which are the only points of contact with support surface 50.

Because the pouch 10 has been described as being made from two sheets 12, 14, it is contemplated that four coplanar feet 84 will be provided. However, if the pouch had a triangular shape, then three coplanar feet could instead be provided. It is merely necessary that at least three coplanar feet be provided in the present invention to thereby provide a stable support for the ouch 10. Because these feet are on the same plane, wobbling of the pouch on support 50 will be prevented. It should be noted in FIG. 2 that when the pouch is flat, the coplanar feet are generally flush with the outermost edge of the rim 34.

Because the portions of the rim are cut away at the beveled end portions 56, 60, the outermost edges of the seems 18 will not engage the support 50. Rather, the coplanar feet 84 will be the only positions at which the flexible pouch 10 engages the support 50. The present pouch 10 will not have outer contact points 78 as shown in FIG. 3. Therefore, as noted, the present pouch 10 will be stably held in position.

Of course, it is possible that only one side of the rim will be cut away. For example, the second beveled end portion 60 of both sections 36, 38 could be omitted such that only a first beveled end portion 56 is provided on the first rim section 36 on both the first sheet 12 and second sheet 14. In such a case, two coplanar feet 84 would be provided on the front and back of the pouch with a third coplanar foot being formed by the point at which the non-cut away seam 18 engages the support 50. This point of contact would be similar to the present invention having one of the two contact points 78 in the conventional pouch of FIG. 3. In either arrangement, coplanar feet 84 provided on the rim 34 stabilize the pouch.

Due to the provision of the coplanar feet, a longitudinal axis 86 of pouch 10 will be generally perpendicular to the support 50. If this axis 86 were inclined, the pouch could easily tip. This is especially true with a relatively tall pouch such as that shown in FIGS. 1 and 2. In other words, a tall cylindrical pouch can easily be tipped if it is not held in a straight, upright position. This problem is avoided with the present invention due to the provision of the four coplanar feet.

The present invention also provides for a method for stabilizing a flexible pouch. This method includes the steps of forming the pouch 10 with compartment 16. This compartment will have a bottom 32. A rim 34 is provided around the bottom of the compartment. This rim 34 is spaced from the bottom 32 of compartment 16 and has an outer edge spaced from the compartment. Portions 56, 60 of the rim 34 are removed to form a plurality of coplanar feet 84 on the rim. These coplanar feet 84 will stably hold the pouch when it is on a support 50.

The present invention provides for a flexible pouch and method for making the pouch which results in a stable arrangement. The pouch can assuredly rest on a support 50 without fear of tipping. The provision of the coplanar feet 84 enables the support to be stably held. It is unlikely that the pouch will wobble, teeter or tip over. Wastage of product within the pouch 10 can therefor be avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for making a stabilized flexible pouch comprising the steps of:

forming a pouch with a compartment for receiving a product, the compartment having a bottom with an exterior surface;

providing a rim around the exterior surface of the compartment with the rim having a bottom edge and outer lateral edges;

spacing the bottom edge from the exterior surface of the compartment;

removing a portion of the rim at the outer lateral edges to provide for a plurality of coplanar points of contact on the rim; and expanding the pouch, such that the bottom of the compartment is generally flat, to form the plurality of spaced, coplanar points of contact on the rim separated by non-contact portions of the rim such that, when placed on a flat surface, the coplanar points of contact of the rim contact the flat surface and the non-contact portions of the rim are raised from the flat surface.

2. The method according to claim 1, wherein the step of removing comprises the step of cutting two end portions of the rim to form a middle portion and two beveled end portions on the rim, the coplanar feet being on the middle portion of the rim.

3. The method according to claim 2, wherein the step of cutting includes cutting the rim such that an angle between 4 and 25° is formed at the outer edge of the rim between the middle portion and each of the two beveled end portions.

4. The method according to claim 2, wherein the step of forming a pouch comprises sealing two sheets to form seams along opposed sides of the compartment, each of the seams extends to and engages the rim, each of the beveled end portions engaging one of the seams.

5. The method according to claim 1, wherein the step of removing forms four coplanar feet on the rim.

6. The method of claim 1, wherein the bottom of the compartment is spaced from the flat surface.

* * * * *